US006004371A

United States Patent [19]

Rolander et al.

[11] Patent Number: 6,004,371

[45] Date of Patent: Dec. 21, 1999

[54] TITANIUM-BASED CARBONITRIDE ALLOY WITH CONTROLLABLE WEAR RESISTANCE AND TOUGHNESS

[75] Inventors: Ulf Rolander, Bromma; Gerold Weinl, Älvsjö; Per Lindahl; Hans-Olof Andrén, both of Göteborg, all of Sweden

[73] Assignee: Sandvik AB, Sandviken, Sweden

[21] Appl. No.: 08/875,139

[22] PCT Filed: Jan. 19, 1996

[86] PCT No.: PCT/SE96/00052

§ 371 Date: Feb. 2, 1998

§ 102(e) Date: Feb. 2, 1998

[87] PCT Pub. No.: WO96/22403

PCT Pub. Date: Jul. 25, 1996

[30] Foreign Application Priority Data

Jan. 20, 1995 [SE] Sweden ..... 9500236

[51] Int. Cl.[6] ..... C22C 29/04

[52] U.S. Cl. ..... 75/238; 75/242

[58] Field of Search ..... 75/237, 238, 242

[56] References Cited

U.S. PATENT DOCUMENTS

| | | | |
|---|---|---|---|
| 4,778,521 | 10/1988 | Iyori et al. | 75/237 |
| 4,904,445 | 2/1990 | Iyori et al. | 419/13 |
| 4,985,070 | 1/1991 | Kitamura et al. | 75/238 |
| 5,051,126 | 9/1991 | Yasui et al. | 75/238 |
| 5,308,376 | 5/1994 | Oskarsson | 75/238 |
| 5,395,421 | 3/1995 | Weinl et al. | 75/238 |
| 5,462,574 | 10/1995 | During et al. | 75/238 |
| 5,468,278 | 11/1995 | Nakahara et al. | 75/236 |
| 5,470,372 | 11/1995 | Weinl | 75/238 |
| 5,659,872 | 8/1997 | During et al. | 419/13 |
| 5,766,742 | 6/1998 | Nakamura et al. | 428/210 |

FOREIGN PATENT DOCUMENTS

| | | |
|---|---|---|
| 3100926 | 8/1982 | Germany . |

*Primary Examiner*—Ngoclan Mai

*Attorney, Agent, or Firm*—Burns, Doane, Swecker & Mathis, L.L.P.

[57] ABSTRACT

The present invention relates to a sintered body of titanium-based carbonitride alloy comprising hard constituents containing at least tungsten in addition to titanium in a binder phase based on cobalt. There are four distinctly different microstructural components, namely: A) cores which are remnants of and have a metal composition determined by the raw material powder; B) tungsten-rich cores formed during the sintering; C) outer rims with intermediate tungsten content formed during the sintering; and D) a binder phase of a solid solution of at least titanium and tungsten in cobalt. Toughness and wear resistance are varied by adding WC, (Ti,W)C, and/or (Ti,W)(C,N) in varying amounts as raw materials.

5 Claims, 2 Drawing Sheets

TITANIUM-BASED CARBONITRIDE ALLOY WITH CONTROLLABLE WEAR RESISTANCE AND TOUGHNESS

BACKGROUND OF THE INVENTION

The present invention relates to a sintered body of carbonitride alloy with titanium as main component and containing tungsten and cobalt. This alloy is preferably used as an insert material in cutting tools for machining of metals, e.g., turning, milling and drilling. For a given gross composition, it is possible to optimize the relation between toughness and wear resistance of the alloy by choosing the form in which tungsten is added.

Titanium-based carbonitride alloys, so-called cermets, are today well established as insert materials in the metal cutting industry and are especially used for finishing. They consist of carbonitride hard constituents embedded in a metallic binder phase. The hard constituent grains generally have a complex structure with a core surrounded by a rim of other composition.

In addition to titanium, group VIa elements, normally both molybdenum and tungsten and sometimes chromium, are added to facilitate wetting between binder and hard constituents and to strengthen the binder by means of solution hardening. Group IVa and/or Va elements, i.e., Zr, Hf, V, Nb and Ta, are also added, mainly in order to improve the thermomechanical behaviour of the material, e.g., its resistance to plastic deformation and thermal cracking (comb cracks). All these additional elements are usually added as carbides, nitrides and/or carbonitrides. The grain size of the hard constituents is usually <2 $\mu$m. The binder phase is normally a solid solution of mainly both cobalt and nickel. The amount of binder phase is generally 3–25 wt%. Furthermore, other elements are sometimes used, e.g., aluminium, which are said to harden the binder phase and/or improve the wetting between hard constituents and binder phase.

As a result of the rather large number of elements generally added to the alloy, it is practically impossible to predict the effect that alterations of the chemical composition may have on the performance of the alloy as cutting tool. However, simple compositions with few alloying elements have hitherto not been available with sufficiently good properties to be able to compete in real cutting tool applications. Also, due to their high nickel content, it has previously not been possible to apply wear resistant coatings (e.g., Ti(C,N)- and $Al_2O_3$- coatings) on titanium based carbonitride alloys using the chemical vapor deposition (CVD) technique common for WC-Co based alloys. The reason for this is the strong catalytic properties of nickel.

However, several previous patents and patent applications deal with the question of in which form the carbide and/or nitride forming elements should be added in order to obtain reasonable wear resistance and toughness of the material. in the Swedish patent SE B 467 257 (which corresponds to U.S. Pat No. 5,308,367) one method is disclosed in which prealloyed raw material powders are used in order to obtain the desired chemical composition of the hard phase cores. By a proper combination of tungsten and carbon rich cores giving high wear resistance, tantalum-rich cores giving high resistance against plastic deformation, and titanium-rich cores giving high toughness it is possible to balance these properties in a desired way. The method relies on the possibility to avoid that the thermodynamically least stable raw materials are dissolved during sintering.

UK patent application GB 2 227 497 (which corresponds to U.S. Pat. No. 5,051,126) A discloses a similar method.

The raw materials are prealloyed in such a way that the sintered body contains only two types of hard phase grains. The first type is single phase nitrides or carbonitrides of group IVa metals, i.e. grains which lack the usual core/rim structure. The second type has a core/rim structure where the core contains significantly more group Va metals and tungsten than the surrounding rim. Again, since the desired cores are remnants of the raw material powder it is vital that the raw materials are designed in such a way that they are not dissolved to any large extent during sintering.

The Swedish patent SE B 470 481 (which corresponds to U.S. Pat. No. 3,395,421) also discloses a method to increase the toughness of the material while maintaining a reasonable hardness, using prealloyed raw materials. The basis of the method is to add essentially all tungsten in the form of a quite specific (probably inhomogeneous) (Ti,W)(C,N) powder. The sintered body contains at least four different types of cores, all of which contains significant amounts of tungsten. In more than 5% of these, at least 50 wt % of the metal content is tungsten. For thermodynamic reasons, such a core cannot form during normal liquid phase sintering. Thus, it is vital for the method that the different components of the raw material do not dissolve completely in the sintering process. Apart from titanium and tungsten, the material also contains at least one additional element chosen from the groups IVa, Va and VIa.

U.S. Pat. No. 4 778 521 discloses an alternative method to increase the toughness of the material while maintaining a reasonable hardness. The basis of this method is to add titanium and tungsten exclusively as Ti(C,N) and WC; respectively, and possibly one additional element selected from the groups IVa, Va and VIa. All hard phase grains in the resulting material consist of three components, a titanium-rich tungsten-poor core, a tungsten-poor titanium-rich intermediate rim surrounding the core and an outer rim with intermediate tungsten content surrounding the intermediate rim. This structure, with intermediate rims of fairly homogeneous thickness completely surrounding the cores, is generally obtained using a nickel based binder. Although the method is interesting it has to our knowledge not been commercialized, most probably due to the inferior high temperature properties of nickel as compared to cobalt.

OBJECTS AND SUMMARY OF THE INVENTION

It is an object of this invention to avoid or alleviate the problems of the prior art.

It is further an object of this invention to provide a sintered titanium based carbonitride alloy having increased and easily controllable wear resistance and/or toughness and a method for producing such alloys.

In one aspect of the invention, there is provided a sintered titanium-based carbonitride alloy containing 2–20 atomic % tungsten and a binder phase of 8–15 atomic % cobalt with an average grain size of <1 $\mu$m. At least 70% of the hard phase grains have a core/rim structure. More than 50% of the cores are remnants from the raw material powders and have a metal composition essentially unaltered by the sintering process. Less than 50% of the cores are formed during sintering. Specific for these cores is that 23–33 at % of the metal content is tungsten, the remainder being titanium. The average N/(C+N) ratio of the material should lie in the range 20–60 at %. Less than 50 at % of the cobalt may be substituted by nickel, less than 20 at % of the tungsten may be substituted by molybdenum, and less than 20 at % of the titanium may be substituted by any elements selected from groups IVa and Va without altering the intentions of the invention. Preferably, however, no additional elements from the groups IVa and Va apart from titanium, no molybdenum and no nickel are intentionally added. This alloy has superior wear resistance and/or toughness and is suitable as a cutting tool material.

In another aspect of the invention, there is provided a sintered titanium-based carbonitride alloy with high wear resistance and toughness suitable for coating by the chemical vapor deposition (CVD) technique.

In a third aspect of the invention, there is provided a method of manufacturing a sintered carbonitride alloy in which powders of TiC, TiN and/or Ti(C,N) are mixed with Co powder and powders of WC and/or (Ti,W)C and (Ti,W)(C,N) in order to obtain a desired composition. While maintaining the same gross composition, the relative amounts of tungsten containing powders are chosen to obtain the desired properties of the alloy. In one extreme case, only WC is added to obtain an alloy with superior toughness. In the other extreme case, only (Ti,W)C and/or (Ti,W)(C,N) are added to obtain maximum wear resistance. By mixing suitable amounts of both WC and (Ti,W)C and/or (Ti,W)(C,N) any desired intermediate relation between wear resistance and toughness may be obtained. A titanium-based carbonitride alloy is then manufactured by standard powder metallurgical methods of pressing and sintering.

DETAILED DESCRIPTION OF THE PREFERRED EMBODIMENTS OF THE PRESENT INVENTION

Figure 1:
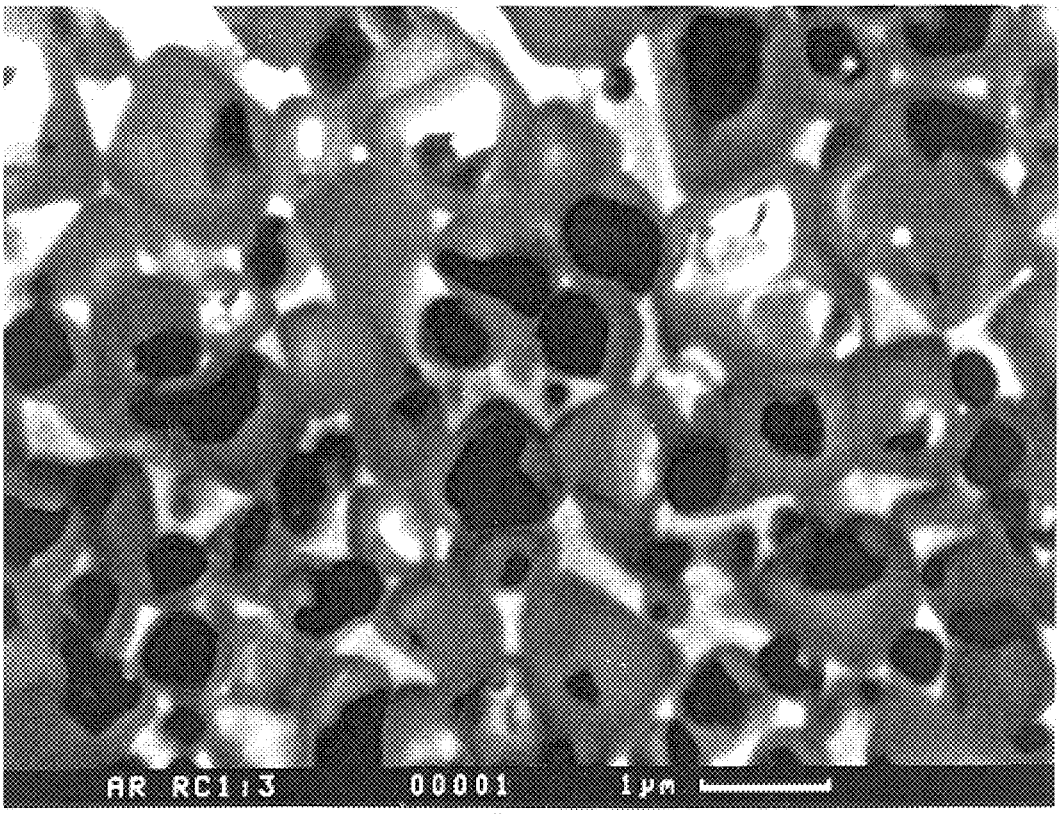

According to the invention; a titanium-based carbonitride alloy, containing tungsten and cobalt, with high and controllable wear resistance and toughness is provided. By carefully choosing the gross composition of the material and in which form the different elements are added, it has surprisingly turned out that a material with superior properties may be obtained. Specifically, the form in which tungsten is added controls the relation between wear resistance and toughness of the material.

A titanium-based carbonitride alloy according to the invention is manufactured by powder metallurgical methods. Powders forming binder phase and powders forming the hard constituents are mixed to a mixture with the desired bulk composition, preferably satisfying the relations (atomic fractions) $0.2<N/(N+C)<0.6$, where N is the nitrogen content and C is the carbon content, and $0.04<W/(W+Ti)<0.3$, where W is the tungsten content and Ti is the titanium content. From the mixture, bodies are pressed and sintered using standard techniques. By adding titanium as TiN and/or preferably Ti(C,N) and tungsten as a suitable mixture of WC and (Ti,W)C and/or (Ti,W)(C,N) a material with superior wear resistance and/or toughness can be obtained. Furthermore, by choosing the relative amounts of WC and (Ti,W)C and/or (Ti,W)(C,N) the relation between wear resistance and toughness can be optimized for a specific application.

While we do not wish to be bound to any theory, it is strongly believed that the reason for why the relation between wear resistance and toughness depends on the form in which tungsten is added to the material has to do with processes occurring during solid state sintering, i.e., in the approximate temperature interval 900–1350° C., before the eutectic temperature is reached. At this stage of the sintering, tungsten-rich cores are formed in the material. This is due to a reaction between thermodynamically unstable tungsten-rich powder grains and titanium-rich grains and is assisted by the presence of cobalt. The amount of thermodynamically unstable tungsten-rich grains added to the powder mixture thus determines the amount of tungsten-rich cores formed. Also the more tungsten a raw material contains, the less stable it is. In this respect WC is the least stable tungsten-containing raw material while (Ti,W)C is quite stable provided that the relation $0.04<W/(W+Ti)<0.3$ mentioned above is fulfilled.

At least 70% of the hard phase grains in the sintered alloy has a core/rim structure which can be of two distinctly different types. The first type is the most abundant, more than 50% of the cores, and is characterized by cores which are remnants of the thermodynamically most stable raw material powders, i.e., Ti(C,N), (Ti,W)C and/or (Ti,W)(C,N). The metal content in these cores is essentially unchanged by the sintering process. The second type is the least abundant and is characterized by the previously described tungsten-rich cores formed during sintering. The remaining at most 30% of the hard phase grains have no core/rim structure. These are grains that were under dissolution, due to the normal grain growth process occurring during sintering where small grains are dissolved and larger grains grow, when the sintering process was stopped.

The grains containing tungsten-rich cores have a distinctly different appearance than the grains containing the other type of cores. They are smaller and rounder in shape. For thermodynamic reasons, the tungsten-rich cores have a composition of the metallic elements, i.e. with C, N and O excluded, satisfying the relation $W+Mo=28\pm5$ at %.

Both types of cores are surrounded by outer rims formed during liquid phase sintering and during cooling. The composition of these rims is independent of the type of core they surround but can be varied over a vast range of compositions using the bulk composition of the material. Typical for these rims is that they contain less tungsten than the tungsten-rich cores but more tungsten than the raw material cores.

When tungsten-rich cores are obtained, a certain amount of intermediate rims which partly surround the raw material cores is also obtained. These rims have a higher tungsten content than the outer rims. This is believed to be an artefact which to some extent decreases the wear resistance of the material. The formation of intermediate rims is minimized by the use of pure cobalt as binder phase. However, some addition of nickel may be allowed without altering the intention of the invention although this is believed to decrease the toughness and wear resistance of the material. If more than 50 at % of the cobalt is substituted by nickel the formation of tungsten-rich cores is fully suppressed and intermediate rims which completely surround the cores are obtained.

If in addition molybdenum-rich raw material is added, the tungsten content of the tungsten-rich cores and the outer rims will be partly substituted for molybdenum, due to the chemical similarities between the two elements. This does not alter the intentions of the invention provided that the ratio $Mo/(Mo+W)$ is less than 20 at %.

It is also possible to substitute a portion of the titanium by elements from groups IVa and Va. This will increase the plastic deformation resistance of the material somewhat but at the expense of wear resistance and toughness. Less than 20 at %, preferably less than 10 at %, of the titanium may be substituted without altering the intentions of the invention.

An interesting aspect of the invention is that high wear resistance and toughness is obtained without addition of nickel. Thus, the sintered bodies can easily be coated using the chemical vapor deposition technique (CVD) to further improve its wear resistance. The alloy can also be coated using the physical vapor deposition technique (PVD) commonly employed for cermets. The invention is additionally illustrated in connection with the following Examples which are to be considered as illustrative of the present invention. It should be understood, however, that the invention is not limited to the specific details of the Examples.

EXAMPLE 1

Four powder mixtures, all with a gross composition of (atom %) 40.8 Ti, 3.6 W, 31.0 C, 13.3 N and 11.3 Co, were manufactured from different raw materials according to Table 1.

TABLE 1

Composition of the four powder mixtures. In the chemical formulas of the raw materials the composition is given as site fractions, while in the table the composition is given as weight % of the different raw materials

| Alloy | 1 | 2 | 3 | 4 |
|---|---|---|---|---|
| WC | 0 | 0 | 18.1 | 18.1 |
| $(Ti_{0.92}W_{0.08})(C_{0.70}N_{0.30})$ | 82.6 | 0 | 0 | 0 |
| $(Ti_{0.89}W_{0.11})C$ | 0 | 61.1 | 0 | 0 |
| TiN | 0 | 21.5 | 0 | 21.5 |
| $Ti(C_{0.67}N_{0.33})$ | 0 | 0 | 64.5 | 0 |
| TiC | 0 | 0 | 0 | 43.0 |
| Co | 17.1 | 17.1 | 17.1 | 17.1 |

The powder mixtures were wet milled, dried and pressed into inserts of the type TNMG 160408-MF which were dewaxed and then vacuum sintered at 1430° C. for 90 minutes using standard sintering techniques. The four alloys were then characterized using optical microscopy, scanning electron microscopy (SEM), transmission electron microscopy (TEM) and energy dispersive X-ray analysis (EDX) as main techniques.

Figure 2:
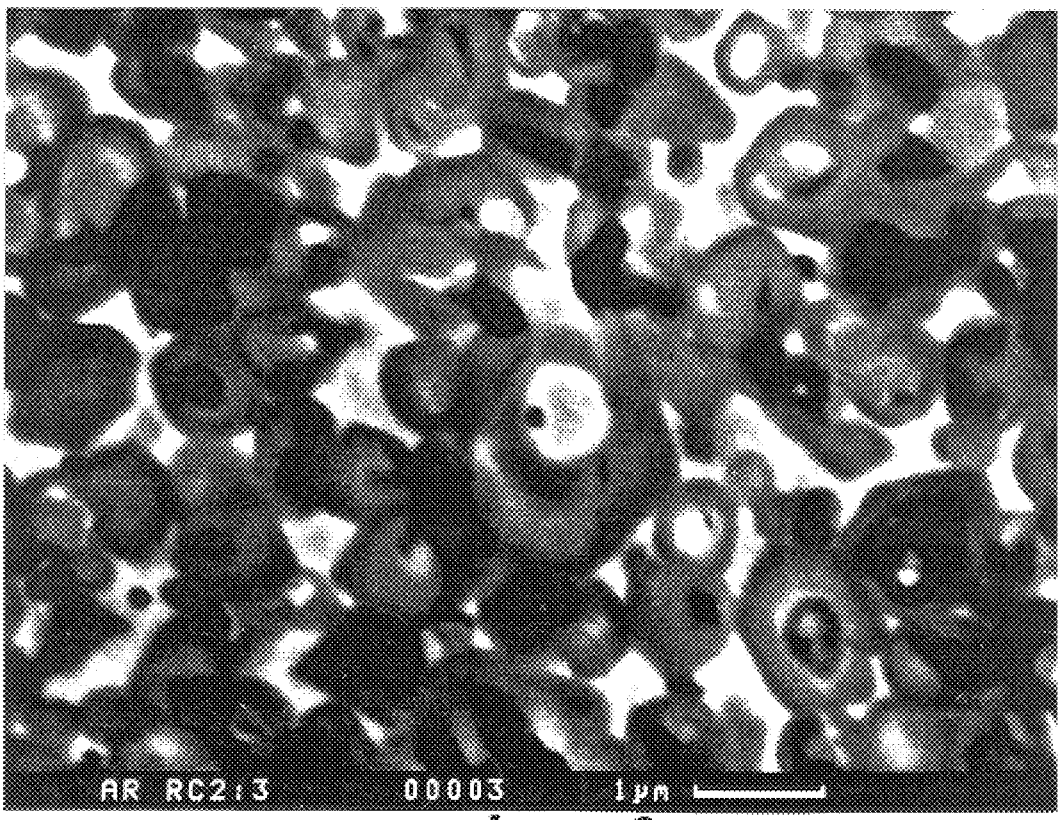
Figure 3:
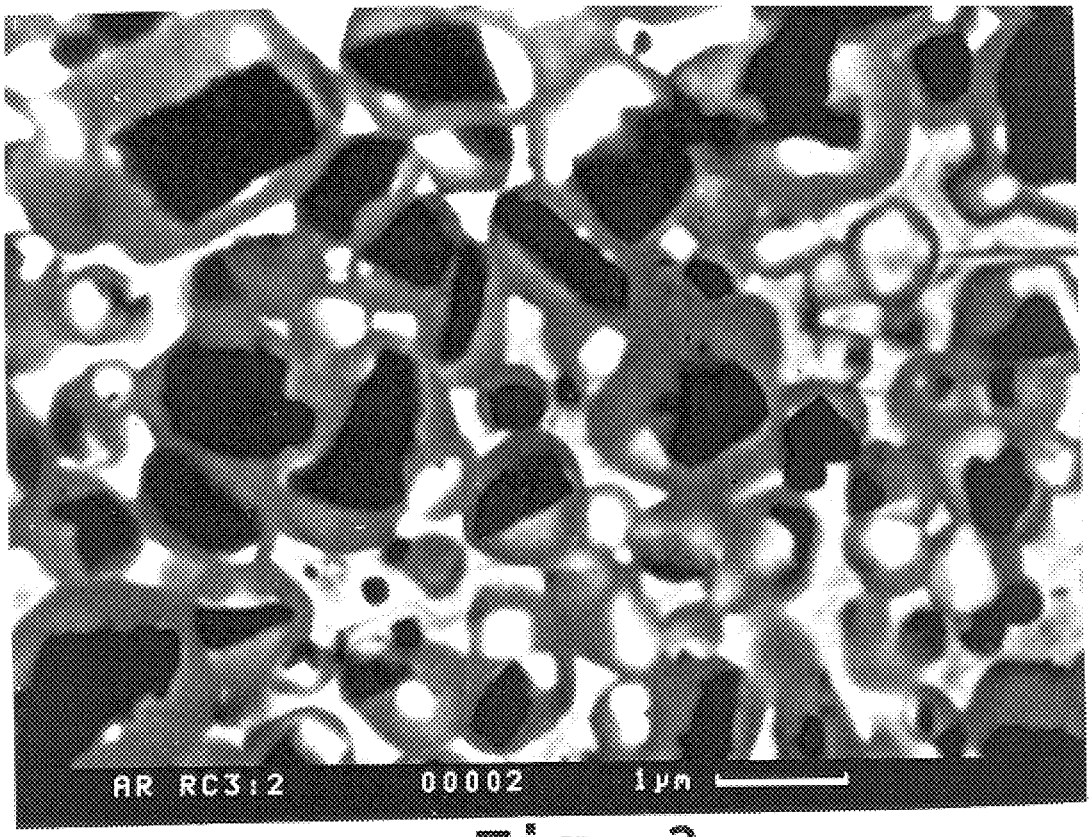
Figure 4:
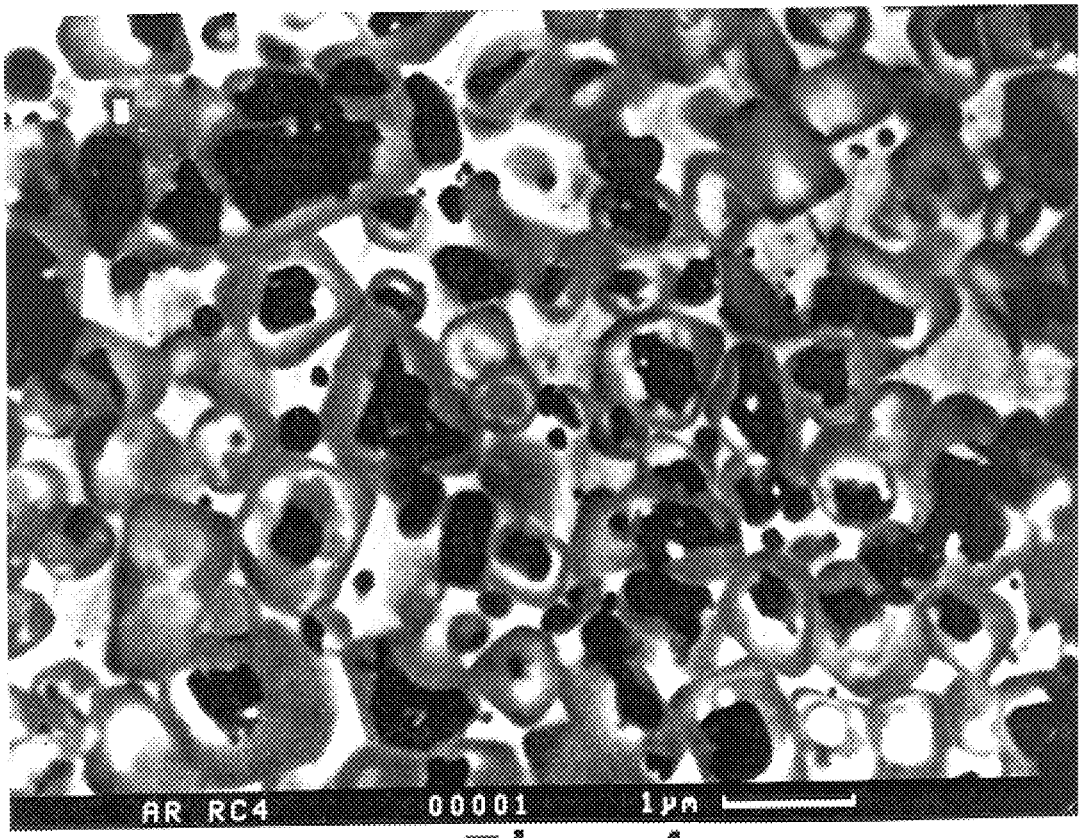

FIGS. 1–4show SEM micrographs of the four alloys. Alloy 4 has a rather inhomogeneous microstructure and also turned out to be quite porous. For these reasons, it is not suitable as insert material and is included here only to show that prealloyed raw materials must, at least to some extent, be used to obtain the desired properties. Alloys 1–3 have very similar microstructure containing titanium-rich cores (black on the micrographs), tungsten-rich cores and intermediate rims (bright), tungsten containing outer rims (dark grey) and cobalt-rich binder phase (light grey). As can be seen, alloy 2, manufactured without WC as raw material, contains the smallest amount of tungsten-rich cores. Alloy 3, where all of the tungsten was added as WC, contains the largest amount of tungsten-rich cores. Alloy 1 is a special case. The (Ti,W)(C,N) powder used turned out to be inhomogeneous and contained one relatively unstable tungsten-rich fraction and one titanium-rich, stable fraction. This alloy is therefore an intermediate case compared to alloys 2–3. EDX analysis in TEM showed that in all four alloys the composition of the tungsten-rich cores satisfies the relation W/(Ti+W)=0.28+0.05, where W is the tungsten content and Ti is the titanium content, both expressed as at %. Image analysis of SEM micrographs obtained from alloy 3 shows that the number of tungsten-rich grains formed during sintering is in the range 20–40% which corresponds to a volume fraction of 9±3 vol %. Alloy 2 also contains a small amount of grains with tungsten-rich cores. The reason for this is that a small amount of WC is obtained in the powder during milling, since the milling bodies consist of WC-Co.

EXAMPLE 2

Inserts of the type TNMG 160408-MF were manufactured of a powder mixture consisting of (in weight %) 10.8 Co, 5.4 Ni, 19.6 TiN, 28.7 TiC, 6.3 TaC, 9.3 $Mo_2C$, 16.0 WC and 3.9 VC. This is a well-established cermet grade within the P25-range for turning and is characterized by a well-balanced behaviour concerning wear resistance and toughness. These inserts were used as a reference in a wear resistance test (longitudinal turning) together with the inserts of alloys 1–3 manufactured according to example 1 above. The following cutting data were used:

| | |
|---|---|
| Work piece material: | Ovako 825B |
| speed: | 250 m/minute |
| feed: | 0.2 mm/rev. |
| depth of cut: | 1.0 mm |
| Coolant: | yes |

Three edges of each alloy were tested. Flank wear (VB) and crater wear area ($k_a$) were measured continuously and the test was run until end of tool life was reached. The tool life criterion was edge fracture due to excessive crater wear. The result expressed in terms of relative figures is given in table 2.

TABLE 2

Result of the wear resistance test

| Alloy | resistance against flank wear | resistance against crater wear | relative tool life |
|---|---|---|---|
| ref. | 1.0 | 1.0 | 1.0 |
| 1 | 0.88 | 1.76 | 1.43 |
| 2 | 1.54 | 1.26 | 2.1 |
| 3 | 0.88 | 0.81 | 1.12 |

Clearly, especially alloy 2 but also alloy 1 has superior tool life compared to the reference. This is due to their high resistance against crater wear. Interestingly alloy 3 also has better tool life in spite of its inferior wear resistance. Probably, it is the excellent toughness of the alloy which allows more wear before edge fracture happens.

EXAMPLE 3

In order to investigate their toughness behaviour, the same inserts as in example 2 (including the same reference) were tested in a heavy interrupted turning operation under the following conditions:

| | |
|---|---|
| Work piece material: | SS 2234 |
| speed: | 250 m/minute |
| feed: | 0.3 mm/rev. |
| depth of cut: | 0.5 mm |
| Coolant: | yes |

Four edges of each alloy were tested. All edges were run to fracture or to 100 cuts. The result is given in table 3.

TABLE 3

| Result of the toughness test | | |
|---|---|---|
| Alloy | average number of cuts | relative tool life |
| ref. | 45 | 1.0 |
| 1 | 73 | 1.62 |
| 2 | 57 | 1.27 |
| 3 | >95 | >2.11 |

In the case of alloy 3, two edges obtained fracture after 90 cuts while the two other survived 100 cuts. This alloy thus showed a very large improvement in toughness. Due to its high toughness it outperforms the reference in both the toughness and the wear resistance test. Interestingly, alloy 2, the most wear resistant of the three obtains a better result in the toughness test than the reference. Thus, even though it is optimized for wear resistance it has sufficient toughness. Alloy 1 which was designed to have intermediate properties also obtained intermediate results (though better than the reference) in both tests. The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. A sintered body of titanium-based carbonitride alloy, comprising hard constituents in a binder phase, containing 8–15 at % cobalt, tungsten in at % satisfying the relation $4<W/(W+Ti)<30$ and nitrogen in at % satisfying the relation $20<N/(N+C)<60$, in which less than 50 at % of the cobalt may be substituted by Ni, less than 20 at % of the tungsten may be substituted by Mo and less than 20 at % of the titanium may be substituted by elements selected from the groups IVa and Va, at most 30% of the hard phase grains are single phase grains which were under dissolution when the sintering process was stopped and at least 70% of the hard phase grains have a core/rim structure with cores of two distinctly different types, namely:

cores which are remnants of and have a metal composition determined by the raw material powders, and tungsten-rich cores, formed during the sintering process, which are smaller and rounder in shape than the raw material cores and have a composition of the metallic elements with C, N and O excluded, satisfying the relation $W+Mo=28\pm5$ at %, whereby both types of cores are surrounded by one type of outer rims formed during sintering and with a tungsten content lower than the tungsten-rich cores but higher than the raw material cores.

2. The sintered body of claim 1 wherein the body contains no additional elements from the groups IVa and Va other than titanium.

3. The sintered body of claim 1 wherein molybdenum is not intentionally added.

4. The sintered body of claim 1 wherein nickel is not intentionally added.

5. The sintered body of claim 1 wherein said body is provided with at least one coating deposited by chemical or physical vapor deposition.

* * * * *